United States Patent [19]

Mann

[11] 4,135,932

[45] Jan. 23, 1979

[54] PROCESS FOR PREPARATION OF PHOTOGRAPHIC FILM INVOLVING CORONA TREATMENT OF POLYSTYRENE CONTAINING SUBBING LAYERS AND PRODUCT

[75] Inventor: David R. Mann, Colchester, England

[73] Assignee: Bexford Limited, London, England

[21] Appl. No.: 723,900

[22] Filed: Sep. 16, 1976

[30] Foreign Application Priority Data

Sep. 26, 1975 [GB] United Kingdom ..... 39569/75

[51] Int. Cl.[2] ..... G03C 1/78

[52] U.S. Cl. ..... 96/87 R; 427/39; 96/85

[58] Field of Search ..... 96/87 R, 85; 427/39

[56] References Cited

U.S. PATENT DOCUMENTS

| | | | |
|---|---|---|---|
| 3,630,742 | 12/1971 | Crawford | 96/87 R |
| 3,697,305 | 10/1972 | Tatsuta et al. | 96/87 R X |
| 3,751,280 | 8/1973 | Nerurkar et al. | 96/87 R |

*Primary Examiner*—John D. Welsh

*Attorney, Agent, or Firm*—Cushman, Darby & Cushman

[57] ABSTRACT

Photographic film bases and sensitized photographic films are produced by coating a supporting film with an aqueous dispersion or a solution in an organic solvent of an essentially water-insoluble homopolymer and/or copolymer of styrene and/or a styrene derivative to form an adherent polymeric subbing layer which is then subjected to a surface modifying, e.g. corona discharge, treatment. Light-sensitive photographic emulsions adhere directly to the treated subbing layer without the need for an intermediate gelatin subbing layer.

15 Claims, No Drawings

PROCESS FOR PREPARATION OF PHOTOGRAPHIC FILM INVOLVING CORONA TREATMENT OF POLYSTYRENE CONTAINING SUBBING LAYERS AND PRODUCT

The present invention relates to a process for the production of a coated photographic film base and to the production of a light-sensitive photographic film by the application of a light-sensitive photographic emulsion to the film base and to the products.

It has been widely accepted in the photographic art that a light-sensitive photographic emulsion applied directly to the surface of a plastics support film does not exhibit sufficient adhesion to the support film for use in most of the usual photographic end uses. As a result, it has become common practice to interpose two or more subbing layers between the support film and the photographic emulsion. For example, when the photographic emulsion comprises a gelatinous silver halide composition, a polymeric subbing layer and then a gelatinous subbing may be applied to the surface of the support film prior to the application of the photographic emulsion to the gelatinous subbing layer.

According to the present invention, a process for the production of a photographic film base comprises coating the surface of a self-supporting plastics film with a subbing composition comprising an aqueous dispersion or a solution in an organic solvent of an essentially water-insoluble homopolymer and/or copolymer comprising styrene and/or a styrene derivative, the styrene and/or a styrene derivative being the major single monomeric constituent of the copolymer, and then subjecting the surface of the applied subbing layer to a modifying treatment to render it adherent to a subsequently superimposed gelatin-containing layer.

The present invention also relates to a photographic film base comprising a self-supporting plastics film and a subbing layer comprising an essentially water-insoluble homopolymer and/or copolymer comprising styrene and/or a styrene derivative, the styrene and/or a styrene derivative being the major single monomeric constituent of the copolymer, the subbing layer being adherent to the plastics film and having been subjected to a surface modifying treatment.

According to this invention, light-sensitive photographic emulsions, such as gelatinous silver halide emulsions, adhere directly to the treated polymeric subbing layer of the base without further treatment or coating, e.g. with a gelatinous subbing layer. On the other hand, it has been found that gelatinous subbing layers also adhere strongly to the treated polymeric subbing layer and that light-sensitive photographic emulsion layers adhere strongly via the gelatinous subbing layer. Therefore, according to this invention, a gelatinous subbing layer may be interposed between the treated polymeric subbing layer and the light-sensitive emulsion layer of a light-sensitive photographic emulsion, although it is preferred to apply the light-sensitive photographic emulsion directly to the surface of the treated polymeric subbing layer for simplicity and economy of production and also to avoid certain technical disadvantages which may be associated with gelatinous layers, for example tackiness in damp or humid conditions, high surface friction which can create winding problems, optical interference patterns on the film, static charge generation and an effect termed "ageing in contact" which results from components, such as hardening agents, included in coatings on the other side of the film migrating into the gelatinous subbing layer when the coated film is wound into a reel and causing premature cross-linking of the gelatin subbing layer which impairs the adhesion of the light-sensitive emulsion to the gelatin subbing layer.

The self-supporting plastics film may consist of any suitable plastics film, such as films of polysulphones and linear polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl, glycol and 1,4-cyclohexanedimethanol. Biaxially oriented and heat-set films of polyethylene terephthalate are particularly useful for the production of the photographic films according to this invention. Such self-supporting plastics films may be transparent and light-transmitting, optionally including photographically inert dyestuffs, e.g. blue dyestuffs for X-ray films, or may be rendered opaque by the addition of additives, such as pigments and fillers, and may in particular have a white and paper-like texture which may be achieved by the addition of suitable fillers and/or by voiding. The white and paper-like films may be used as bases for photographic prints.

The styrene and/or styrene derivative homopolymers and copolymers which are used in the subbing compositions according to this invention are essentially water-insoluble. It will be appreciated that water-soluble polymers whould be dissolved by the aqueous solutions which are normally used for photographic processing, e.g. for development and fixing, thereby destroying the adhesion of superimposed gelatinous layers to the underlying plastics film. The invention does not therefore extend to water-soluble polymers such as those which may be produced from monomers comprising an ionic component or group. Accordingly, the invention is concerned exclusively with essentially water-insoluble polymers which must be applied as aqueous dispersions or as solutions in organic solvents.

Styrene derivatives suitable for the production of the subbing polymer preferably comprise chloro styrene, hydroxy styrene and alkylated styrenes.

When the subbing polymer comprises a styrene and/or styrene derivative copolymer, the styrene and/or styrene derivative must be the major single monomeric constituent of the copolymer, i.e. the molar proportion of styrene or the styrene derivative must exceed the molar proportion of each other comonomer. Generally, the molar proportion of the styrene and/or styrene derivative monomer should preferably exceed 25 mole % of the copolymer.

Styrene and styrene derivative copolymers alone provide slightly better adhesion properties than the homopolymers alone although the adhesion of the homopolymers may be improved by the addition of a cross-linking agent. It is therefore preferred to employ copolymers. Decreasing proportions of the styrene and/or styrene derivative comonomer in the copolymer result in a correspondingly slightly poorer dry adhesion of superimposed gelatin-containing layers. It has been found that a satisfactory combination of properties may be obtained from copolymers derived from two monomers only when the styrene and/or styrene derivative is present in a preferred proportion within the range 60 to 90 mole %. Satisfactory properties are provided by terpolymers comprising styrene and/or a styrene derivative in the range 35 to 90 mole %.

Styrene derivative comonomers may be employed to provide special copolymer properties. Sulphonated styrene derivatives provide anti-static copolymers although they must be employed in such a way that the ionic character of the derivative does not render the copolymer water-soluble. For example, small copolymerised proportions of the sulphonated styrene derivative, e.g. up to about 20 mole %, may be employed without rendering the copolymer water-soluble. Such copolymers may comprise other non-sulphonated styrene and/or styrene derivative monomers so that the overall amount of styrene and/or styrene derivative is within the effective range specified above.

Copolymers of styrene and/or styrene derivatives may comprise one or more ethylenically unsaturated comonomers which are copolymerisable therewith. Suitable comonomers may be selected from $\alpha,\beta$-unsaturated carboxylic acids, such as acrylic and methacrylic acids and their esters and amides, including alkyl esters in which the alkyl group contains up to ten carbon atoms, e.g. methyl, ethyl, propyl, isopropyl, butyl, hexyl, heptyl, n-octyl and 2-ethylhexyl groups, butadiene, acrylonitrile, vinyl estes, such as vinyl acetate, vinyl chloroacetate, vinyl benzoate, vinyl pyridine and vinyl chloride, vinylidene chloride, maleic acid and anhydride and itaconic acid and anhydride. The preferred copolymers may be formed with butadiene, butyl acrylate and/or itaconic acid. Copolymers comprising at least 50, preferably 60, mole % of styrene are especially useful.

Conventional additives may be included in the polymeric subbing layer, e.g. adhesion promoters, such as a partially hydrolysed vinyl acetate/vinyl chloride copolymer optionally admixed with a chlorinated phenol, slip and anti-static agents.

If desired, the subbing dispersion or solution may contain a cross-linking agent which functions to cross-link the subbing polymer thereby improving adhesion to the plastics film. Additionally, the cross-linking agent should preferably be capable of internal cross-linking in order to provide protection against solvent penetration. Suitable cross-linking components may comprise epoxy resins, alkyd resins, amine derivatives such as hexamethoxymethyl melamine, and/or condensation products of an amine, e.g. melamine, diazine, urea, cyclic ethylene urea, cyclic propylene urea, thiourea, cyclic ethylene thiourea, alkyl melamines, aryl melamines, benzo guanamines, guanamines, alkyl guanamines and aryl guanamines with an aldehyde, e.g. formaldehyde. A useful condensation product is that of melamine with formaldehyde. The condensation product may optionally be alkoxylated. The cross-linking agent may be used in amounts of up to 25% by weight based on the weight of the polymer in the subbing composition.

A catalyst is also preferably employed to facilitate cross-linking. Preferred catalysts for cross-linking melamine formaldehyde include ammonium chloride, ammonium nitrate, ammonium thiocyanate, ammonium dihydrogen phosphate, ammonium sulphate, diammonium hydrogen, phosphate, para toluene sulphonic acid, maleic acid stabilised by reaction with a base, and morpholinium para toluene sulphonate.

According to the invention, the polymeric subbing layer may be applied to the plastics film during or after the completion of the process by which the plastics film is produced.

When the layer is applied after the production of the plastics film, the film may be pretreated or coated in such a way to improve the adhesion of the layer to the film surface. Chemical or physical pre-treatments may be employed to modify the film surface. Such pretreatments may involve coating the film surface with a solution having a swelling, solvent or oxidising action on the film. Alternatively or additionally, the film may be subjected to corona discharge treatment, flame treatment, or ultra-violet light. When the plastics film is a linear polyester, such as polyethylene terephthalate, the pretreatment may involve the application to the film surface of a material having a swelling or solvent action upon the film, e.g. a solution in a common organic solvent such as acetone or methanol of p-chloro-m-cresol, 2,4-dichlorophenol, 2,4,6- or 2,4,5-trichlorophenol or 4-chlororesorcinol or a mixture of such materials in a common organic solvent. If desired, the pretreating solution may contain a polymeric component, e.g. a copolymer of vinyl chloride and vinyl acetate. After such a solution has been applied to the film surface it may be dried at an elevated temperature for a few minutes before applying the subbing composition. Alternatively, the plastics film may carry an adhesion-promoting polymeric layer to which the layer containing the polymeric component may be applied. Suitable layers include polymers and copolymers of acrylic and methacrylic acids and their esters, and copolymers of vinylidene chloride.

If the film is produced by a process of molecular orientation which is normally achieved by stretching in one or more directions it is convenient to apply the polymeric subbing layer during the film production. Usually, oriented films are biaxially oriented by stretching in two mutually perpendicular directions, for example as is the case with polyethylene terephthalate films. The subbing layer may be applied before the stretching operation is commenced, or more preferably between the stretching operations applied in the two perpendicular directions. Such a sequence of coating between the stretching operations is preferred for the coating of oriented polyethylene terephthalate films. The subbing layer is preferably applied as an aqueous dispersion in such an operation. It has been found that the dry adhesion (as defined below) of homopolymers of styrene applied to polyethylene terephthalate films by such a process may be improved by including a cross-linking agent in the subbing composition.

The procedure for applying the subbing composition may be any of the known coating techniques, such as dip coating, bead coating, reverse roller coating or slot coating.

Alternatively, the plastics film and the subbing layer may be formed by coextrusion or they may be formed by independent operations and then laminated.

The modifying treatment applied to the subbing layer may comprise flame treatment, ion bombardment, electron beam treatment, exposure to ultra-violet light or preferably corona discharge treatment.

Corona discharge treatment may be effected in air at atmospheric pressure with conventional equipment using a high frequency, high voltage generator, preferably having a power output of from 1 to 20 kw at a potential of 1 to 100 kv. Discharge is conveniently accomplished by passing the film over a dielectric support roller at the discharge station at a linear speed preferably of 1.0 to 500 m per minute. The discharge electrodes may be positioned 0.1 to 10.0 mm from the moving film surface. The applied subbing layer should preferably exhibit a wetting test value after corona discharge treatment exceeding 56 dynes/cm when measured by the Union Carbide Standard Wetting Test (WC 81-3/1964) with a formamide/'Cellosolve' mixture, whereas the value exhibited by an untreated layer is generally in the range 34 to 38 dynes/cm. In this test, liquid mixtures having a range of surface tensions are made up using various concentrates of formamide in 'Cellosolve' (2-ethoxy ethanol) and brushed onto the surface to be examined. The wetting test value is the surface tension of the liquid mixture having the highest surface tension which does not contract into droplets within two seconds after application onto the surface.

Polymeric subbing layers having a coat weight in the range 0.1 to 10 mg/dm$^2$ provide satisfactory adhesion. Coat weights in the range 1.0 to 3.0 mg/dm$^2$ are preferred.

The polymeric subbing layers applied according to this invention to polyethylene terephthalate films are such that the film base is suitable for recycling through the film-forming extruder and stretching equipment.

The invention also relates to a process for the production of a photographic film which comprises applying a light-sensitive photographic emulsion over the surface modified polymeric subbing layer of a photographic film base produced as described above and to the photographic film.

Any suitable light-sensitive photographic emulsion, such as a conventional gelatinous silver halide emulsion, may be applied by conventional techniques to the surface modified subbing layer. Such an emulsion may contain any of the conventional additives. It has been found that light-sensitive emulsions bond with good adhesion, as stated above, after direct application to the surface modified layer. Therefore, according to this invention, it is preferred to apply the light-sensitive emulsion directly to the surface modified subbing layer in the production of light-sensitive photographic films.

Nevertheless, conventional gelatinous subbing layers may, if desired, be interposed between the surface modified polymeric subbing layer and the light-sensitive photographic emulsion layer. Such gelatin subbing layers may contain any of the usual additives such as polyvinyl acetate, particulate materials, e.g. silica, anti-blocking agents and cross-linking agents, e.g. formalin, and may be applied by any known technique.

The invention is further illustrated by the following examples, in which dry and wet adhesion have the following meanings and were assessed by the following tests.

Dry adhesion refers to the adhesion of a gelatinous silver halide emulsion via an underlying gelatin subbing layer, if present, to the plastics film in the final photographic film, assessed, both before and after processing in standard photographic chemicals, by sticking a self-adhesive tape along the torn edge of the film and rapidly separating the tape from the film.

Wet adhesion refers to the adhesion of a gelatinous silver halide emulsion via an underlying gelatin subbing layer, if present, to the plastics film in the final photographic film, assessed, after processing in the standard photographic chemicals and washing in water for 15 minutes by rubbing with a sponge over a series of lines scored in the still wet emulsion.

EXAMPLE 1

A conventionally biaxially oriented, 100 micron thick, clear polyethylene terephthalate film which had been precoated with a cross-linked copolymer formed from, by weight, 45% ethyl acrylate, 50% methyl methacrylate and 5% methacrylamide was coated over the precoating with a polymeric subbing composition of the following ingredients:

| | |
|---|---|
| An aqueous styrene homopolymer dispersion which is commercially available as 'Vinamul' 7700 | 10 g |
| Distilled water | 90 g |

The coated film was dried at 130° C. for 2 minutes to give a dry copolymer coat weight of 3 mg/dm$^2$.

The film was divided into two parts, A and B.

Part A

A conventional gelatinous silver halide emulsion was applied directly to the copolymer subbing layer without corona discharge treatment, chilled to gel the coating, and dried for 20 minutes at 35° C.

The silver halide emulsion was then tested for adhesion, the dry adhesion before and after processing and the wet adhesion during processing both being extremely poor.

Part B

The copolymeric subbing layer was corona discharge treated in air at atmospheric pressure using a commercially available Vetaphone 3 kw treater to produce a coating having Union Carbide Wetting Test value greater than 56 dynes/cm. The treating conditions were film speed 20 fpm, power 2 kw, electrode to film distance 1.5 mm.

Finally the treated film was coated with a silver halide emulsion as for Part A above.

The resulting photographic film was then tested for adhesion. Dry adhesion was excellent before and after processing and the wet adhesion during processing was satisfactory.

EXAMPLE 2

A conventionally biaxially oriented, 175 micron thick blue-dyed polyethylene terephthalate film suitable for use as an X-ray film which had been precoated with a cross-linked copolymer formed from, by weight, 45% ethyl acrylate, 50% methyl methacrylate and 5% methacrylamide was coated over the precoating with a polymeric subbing composition of the following ingredients:

| | |
|---|---|
| An aqueous styrene homopolymer dispersion which is commercially available as 'Vinamul' 7700 | 10 g |
| Lithium nitrate | 0.2 g |
| Distilled water | 89.8 g |

The lithium nitrate in the above subbing composition provides the necessary anti-static properties for X-ray usage as determined by a surface resistivity of $1 \times 10^{12}$ ohms/sq at 60% relative humidity and 20° C.

The subbed film was dried at 130° C. for 2 minutes to give a dry copolymer coat weight of 3 mg/dm$^2$. The coating was corona discharge treated as in Example 1 (Part B) to produce a similar Union Carbide Wetting Test value.

A conventional gelatinous silver halide emulsion was applied to the treated copolymer layer, chilled, and then dried for 20 minutes at 35° C.

The dry adhesion before and after processing and the wet adhesion was satisfactory.

As a further test for adhesion, the X-ray photographic film was processed using solutions for automatic processing which are commercially available from Kodak Limited under the trade name 'X-omat.' The emulsion showed excellent adhesion.

EXAMPLE 3

A conventionally biaxially oriented, 100 micron thick, clear polyethylene terephthalate film was pretreated with the following solution:

| | |
|---|---|
| p-chloro-m-cresol | 5g |
| A vinyl acetate/vinyl chloride copolymer which is commercially available as 'VAGH' | 1 g |
| Acetone | 100 ml |

The solution was applied to give a wet coat weight of 100 mg/dm$^2$ and dried for 2 minutes at 80° C.

The following subbing solution was applied to the pretreated surface:

| | |
|---|---|
| Homopolystyrene (molecular weight 100,000) | 4 g |
| Methylene chloride | 100 ml |

After drying for 2 minutes at 80° C. the dry coat weight was 4 mg/dm$^2$ and the coating was corona discharge treated as in Example 1 (Part B) to provide a surface having a similar Union Carbide Wetting Test value. The treated subbing layer was further coated with a conventional gelatinous silver halide emulsion which was found to have excellent dry and wet adhesion.

EXAMPLE 4

A conventionally biaxially oriented, 100 micron thick, clear polyethylene terephthalate film which had been precoated with a cross-linked copolymer formed from, by weight, 45% ethyl acrylate, 50% methyl methacrylate and 5% methacrylamide was coated over the precoating with a subbing composition of the following ingredients:

| | |
|---|---|
| An aqueous dispersion of a styrene/acrylic copolymer which is commercially available as 'Vinacryl' 7170 | 10 g |
| Distilled water | 90 g |

The subbing layer was dried for 2 minutes at 100° C. and then corona discharge treated and coated with a silver halide emulsion as described in relation to Part B in Example 1.

The emulsion exhibited good dry and wet adhesion.

EXAMPLE 5

A blue-dyed polyethylene terephthalate film was pretreated as described in Example 2 and the pretreated surface coated with a subbing composition of the following ingredients:

| | |
|---|---|
| An aqueous dispersion of a copolymer of 75 mole % styrene, 19.5 mole % butadiene and 5.5 mole % itaconic acid | 10 g |
| Lithium nitrate | 0.2 g |
| Distilled water | 89.8 g |

The subbing layer was dried for 2 minutes at 100° C. and then corona discharge treated and coated with a silver halide emulsion as described in relation to Part B in Example 1.

The emulsion exhibited good dry and wet adhesion.

EXAMPLE 6

A polyethylene terephthalate film was melt extruded, cast onto a cooled rotating drum and stretched in the direction of extrusion about three times its original dimensions by conventional procedure.

The stretched film was then coated with a subbing composition of the following ingredients:

| | |
|---|---|
| An aqueous styrene homopolymer dispersion which is commercially available as 'Vinamul' 7700 | 10 g |
| Distilled water | 90 g |

The subbed film was passed into a stenter oven where the film was dried and stretched in the sideways direction about three times its original dimensions and heat set at a temperature of about 200° C. by conventional procedure.

The copolymer subbing layer was then corona discharge treated by the procedure described in relation to Part B in Example 1 and coated with a silver halide emulsion which was chilled to gel the coating and dried for 20 minutes at 35° C.

The dry adhesion of the emulsion to the corona discharge treated subbing layer before and after processing and the wet adhesion after processing were satisfactory.

EXAMPLE 7

Example 6 was repeated with the modification that 1 g of hexamethoxymethyl melamine (available commercially under the trade name 'Cymel' 300) was added to the coating dispersion.

The dry adhesion of the emulsion before and after processing and the wet adhesion after processing were satisfactory. The dry adhesion of the subbing layer to the polyethylene terephthalate film was satisfactory and stronger than that of the product of Example 6.

EXAMPLE 8

Example 6 was repeated except that the styrene copolymer subbing composition contained lithium nitrate as an anti-static agent and was composed as follows:

| | |
|---|---|
| An aqueous styrene homopolymer dispersion which is commercially available as 'Vinamul' 7700 | 10 g |
| Lithium nitrate | 0.2 g |
| Distilled water | 89.8 g |

The dry adhesion of the emulsion before and after processing and the wet adhesion after processing were satisfactory.

EXAMPLE 9

Example 6 was repeated except that the styrene homopolymer subbing composition contained dibutyl phthalate as a plasticiser and was composed as follows:

| | |
|---|---|
| An aqueous dispersion of a styrene homopolymer containing 15% by weight of dibutyl phthalate based on the weight of styrene which is commercially available as 'Vinamul' 7715 | 10 g |
| Hexamethoxymethyl melamine which is commercially available as 'Cymel' 300 | 1 g |
| Distilled water | 89 g |

The dry adhesion of the emulsion before and after processing and the wet adhesion after processing was satisfactory.

EXAMPLE 10

A polyethylene terephthalate film was melt extruded, cast onto a coated rotating drum and stretched in the direction of extrusion to about three times its original dimension by conventional procedure.

Samples of the stretched film were then coated on one side with aqueous subbing latices of a styrene homopolymer and a range of styrene/butyl acrylate copolymers having the compositions given in Table 1. The subbing copolymers of Tests f and g in Table 1 are included for comparative purposes.

The subbed films were passed into a stenter where they were dried and stretched in the sideways direction about three times their original dimensions and heat set at a temperature of about 200° C. by conventional procedure. The dry coat weight of the copolymeric subbing layer was approximately 1 mg/dm$^2$ and the films had an overall thickness of about 100 microns.

The coated films were then assessed for blocking and haze as follows:

Blocking, that is the tendency of adjacent layers of film in a reeled film to stick together, was assessed by unwinding the reeled film and grading as none, slight, medium, severe blocking.

Haze was measured using an Eel Spherical Hazemeter (manufactured by Evans Electroselenium of Halstead, Essex, England).

The blocking and haze results are given in Table 1.

The copolymeric subbing layers were then corona discharge treated by the procedure described in relation to Part B in Example 1 and coated with a silver halide emulsion which was chilled to gel the coating and dried for 20 minutes at 35° C.

Finally the photographic material was tested for adhesion and the results are given in Table 1.

TABLE 1

| Test | Subbing Polymer | Styrene:butyl acrylate ratio in copolymer mole % | Haze (%) | Blocking | Adhesion dry | Adhesion wet |
|---|---|---|---|---|---|---|
| a | styrene homopolymer | 100:0 | 28% | none | weak adhesion at film/subbing layer interface | good |
| b | styrene/butyl acrylate copolymer | 90:10 | 3% | none | slight failure at film/subbing layer interface | good |
| c | " | 80:20 | 2% | none | satisfactory | good |
| d | " | 70:30 | 1% | none | satisfactory | good |
| e | " | 60:40 | 1% | slight | satisfactory | good |
| f | " | 50:50 | 1% | severe | failure at subbing layer/photoemulsion interface | good |
| g | " | 40:60 | 1% | severe | failure at subbing layer/photoemulsion interface | good |

The dry adhesion of the styrene homopolymer subbing layer to the polyethylene terephthalate film in Test a was improved by the addition of hexamethoxymethyl melamine to the subbing composition, as illustrated in Example 7.

EXAMPLE 11

Example 6 was repeated except that the subbing composition contained the following ingredients:

| | |
|---|---|
| An aqueous dispersion of a styrene/butyl acrylate/itaconic acid copolymer (70/25/5 mole % respectively) | 10 g |
| Distilled water | 90 g |

The wet and dry adhesions of the applied emulsion was satisfactory.

EXAMPLE 12

Example 6 was repeated except that the stretched film was coated with a coating composition containing an anti-static agent as follows:

| | |
|---|---|
| An aqueous dispersion of a styrene/acrylic copolymer which is commercially available as 'Vinacryl' 7170 | 10 g |
| An anti-static agent of naphthalene sulphonic acid/formaldehyde condensate which is commercially available as 'Altomol' | 2 g |
| Distilled water | 88 g |

The subbed film had anti-static properties and exhibited a surface resistivity of $1 \times 10^{12}$ ohms/square when measured at 20° C. and 60% relative humidity.

The silver halide emulsion applied to the corona discharge treated copolymeric subbing layer was a conventional X-ray photographic emulsion.

The resulting sensitised film gave excellent wet and dry adhesion.

EXAMPLE 13

Example 6 was repeated except that the subbing composition contained the following ingredients:

| | |
|---|---|
| An aqueous dispersion of a styrene/acrylic/acrylonitrile copolymer which is commercially available from Morton Williams Limited and designated AA412 | 10 g |
| Distilled water | 90 g |

The wet and dry adhesions of the applied emulsion were good.

EXAMPLE 14

Example 6 was repeated except that the subbing composition contained the following ingredients:

| | |
|---|---|
| A styrene/ethyl acrylate/methyl methacrylate/itaconic acid copolymer (38/28.5/28.5/5 mole % respectively) latex | 10 g |
| Distilled water | 90 g |

The silver halide emulsion applied to the corona discharge treated copolymeric subbing layer was a conventional X-ray photographic emulsion.

The wet and dry adhesions of the emulsion were satisfactory.

EXAMPLE 15

Example 6 was repeated except that the subbing composition contained the following ingredients:

| | |
|---|---|
| A styrene/ethyl acrylate/acrylamide copolymer (60/35/5 mole % respectively) latex | 10 g |
| Distilled water | 90 g |

The silver halide emulsion applied to the corona discharge treated copolymeric subbing layer was a conventional X-ray photographic emulsion suitable for automatic processing equipment.

The adhesion of the emulsion in the automatic processing chemicals (commercially available from Ilford Limited as 'Rapid R') was good.

EXAMPLE 16

Example 6 was repeated except that the subbing composition contained the following ingredients:

| | |
|---|---|
| A styrene/ethyl acrylate/glycidyl methacrylate copolymer (60/35/5 mole % respectively) latex | 10 g |
| Distilled water | 90 g |

The wet and dry adhesions were good.

EXAMPLE 17

A blue dyed polyethylene terephthalate film was stretched and coated with a subbing composition by the procedure described in Example 6.

The subbing composition was:

| | |
|---|---|
| An aqueous dispersion of a styrene/butadiene copolymer (85/15 mole % respectively) which is commercially | |

-continued

| | |
|---|---|
| available as Borg Warner 1600 | 10 g |
| Distilled water | 90 g |

The silver halide emulsion applied to the corona discharge treated copolymeric layer was a conventional X-ray photographic emulsion.

The wet adhesion of the emulsion was excellent.

EXAMPLE 18

Example 4 was repeated except that the subbing composition included a copolymer having anti-static properties and was as follows:

| | |
|---|---|
| An aqueous styrene/butyl acrylate/dimethylaminoethylmethacrylate (70/25/5 mole % respectively) latex [dimethylaminoethylmethacrylate was neutralised to pH7 using acetic acid prior to the latex preparation] | 10 g |
| Distilled water | 90 g |

The subbed film had anti-static properties and exhibited a surface resistivity of $2 \times 10^{10}$ ohms/square when measured at 20° C. and 60% relative humidity.

The silver halide emulsion applied to the corona discharge treated polymeric subbing layer was a conventional X-ray photographic emulsion.

The wet and dry adhesions of the emulsion were satisfactory.

EXAMPLE 19

A synthetic paper for photographic uses comprising an opaque white/polyethylene terephthalate film which contained a particulate filler and became voided upon stretching was stretched and coated with a subbing composition by the procedure described in Example 6. The subbing composition was:

| | |
|---|---|
| An aqueous dispersion of a styrene homopolymer containing 15% by weight of dibutyl phthalate based on the weight of the styrene which is commercially available as 'Vinamul' 7715 | 10 g |
| Hexamethoxymethyl melamine which is commercially available as 'Cymel' 300 | 1 g |
| Distilled water | 89 g |

The adhesion of the emulsion to the corona discharge treated film was good and the sensitised assembly was suitable for the production of photographic prints.

EXAMPLE 20

Example 19 was repeated except that the opaque white film was coated with a subbing composition of the following ingredients:

| | |
|---|---|
| An aqueous dispersion of a styrene/acrylic copolymer which is commercially available as 'Vinacryl' 7170 | 10 g |
| Distilled water | 90 g |

The wet and dry adhesions of the emulsion to the corona discharge treated subbing layer was good and the sensitised assembly was suitable for the production of photographic prints.

EXAMPLE 21

A conventionally biaxially oriented 100 micron thick clear polyethylene terephthalate film was pretreated as in Example 3.

The following subbing solution was then applied:

| | |
|---|---|
| Homo-4-chlorostyrene | 3 g |
| methylene chloride | 100 ml |

After drying for 2 minutes at 80° C., the dry coat weight was approximately 2 mg/dm$^2$.

The subbing layer was corona discharge treated as in Example 1 (Part B) and a silver halide emulsion applied over the treated surface.

The wet and dry adhesion of the emulsion was satisfactory.

EXAMPLE 22

Example 21 was repeated except that the pretreated film was coated with a subbing solution of the following ingredients:

| | |
|---|---|
| A styrene/acrylonitrile copolymer (90/10 mole % respectively) | 3 g |
| Methyl ethyl ketone | 100 ml |

The wet and dry adhesion of the emulsion was good.

I claim:

1. A process for the production of a light sensitive photographic film, which comprises coating the surface of a self-supporting plastics film with a subbing composition consisting essentially of an aqueous dispersion or a solution in an organic solvent of an essentially water-insoluble homopolymer and/or copolymer comprising styrene and/or a styrene derivative, the styrene and/or a styrene derivative being the major single monomeric constituent of the copolymer, subjecting the surface of the applied subbing layer to a corona discharge modifying treatment and applying a light-sensitive photographic emulsion layer directly to the surface of the treated polymeric subbing layer.

2. A process according to claim 1, in which the subbing composition comprises a copolymer of styrene and/or a styrene derivative.

3. A process according to claim 2, in which the copolymer is derived from butadiene, butyl acrylate and/or itaconic acid.

4. A process according to claim 4, in which the copolymer is derived from two monomers only and the molar proportion of the styrene and/or styrene derivative in the copolymer is within the range 60 to 90 mole %.

5. A process according to claim 4, in which the copolymer is a terpolymer and the molar proportion of the styrene and/or styrene derivative in the terpolymer is within the range 35 to 90 mole %.

6. A process according to claim 1, in which the subbing composition is applied to the plastics film during the process by which the film is produced.

7. A process according to claim 6, in which the plastics film is biaxially oriented by stretching in two mutually perpendicular directions and the subbing composition is applied between the stretching operations in the two directions.

8. A process according to claim 1, in which the plastics film comprises a biaxially oriented and heat set polyethylene terephthalate film.

9. A photographic film produced by the process of claim 1.

10. A light sensitive photographic film, which comprises a self-supporting plastics film and a subbing layer consisting essentially of an essentially water-insoluble homopolymer and/or copolymer comprising styrene and/or a styrene derivative, the styrene and/or a styrene derivative being the major single monomeric constituent of the copolymer, the subbing layer being adherent to the plastics film and having been subjected to a surface modifying treatment by corona discharge to provide a wetting test value exceeding 56 dynes/cm when measured by the Union Carbide Standard Wetting Test, and a light-sensitive photographic emulsion layer applied directly to the treated surface of the copolymeric subbing layer and adhering thereto.

11. A photographic film base according to claim 10, in which the polymeric subbing layer comprises a copolymer of styrene and/or a styrene derivative.

12. A photographic film base according to claim 11, in which the copolymer is derived from butadiene, butyl acrylate and/or itaconic acid.

13. A photographic film base according to claim 11, in which the copolymer is derived from two monomers only and the molar proportion of the styrene and/or styrene derivative in the copolymer is within the range 60 to 90 mole %.

14. A photographic film base according to claim 11, in which the copolymer is a terpolymer and the molar proportion of the styrene and/or styrene derivative in the terpolymer is within the range 35 to 90 mole %.

15. A photographic film base according to claim 10, in which the plastics film comprises a biaxially oriented and heat set polyethylene terephthalate film.

* * * * *